US012000597B2

(12) United States Patent
Roales et al.

(10) Patent No.: US 12,000,597 B2
(45) Date of Patent: Jun. 4, 2024

(54) SYSTEMS AND METHODS FOR THE ADJUSTMENT OF TOE KICK PLATES

(71) Applicant: Haier US Appliance Solutions, Inc., Wilmington, DE (US)

(72) Inventors: Scott Edward Roales, Wadesville, IN (US); Eric Dean Lively, Elberfeld, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 274 days.

(21) Appl. No.: 17/592,625

(22) Filed: Feb. 4, 2022

(65) Prior Publication Data

US 2023/0250971 A1 Aug. 10, 2023

(51) Int. Cl.
*F24C 15/36* (2006.01)
*F24C 15/08* (2006.01)

(52) U.S. Cl.
CPC ..... *F24C 15/36* (2013.01); *F24C 15/08* (2013.01)

(58) Field of Classification Search
CPC ..... F24C 15/08; F24C 15/06; F24C 15/097; F16M 13/022; A47L 15/4251; D06F 39/12; F25D 23/065
See application file for complete search history.

(56) References Cited

U.S. PATENT DOCUMENTS 2,295,915 A * 9/1942 Ring ..... F24C 15/08 312/265.5
4,932,224 A * 6/1990 Katterhenry ..... F25D 23/10 312/236
6,036,292 A * 3/2000 Mandel ..... F25D 23/062 312/401
7,137,677 B2 * 11/2006 Hong ..... F25D 23/00 312/265.6
8,511,762 B2 * 8/2013 Stegerwald ..... A47L 15/4251 312/265.6
10,874,282 B2 * 12/2020 Kim ..... A47L 15/4265
11,035,163 B2 * 6/2021 Braden ..... E05D 3/022
2002/0005024 A1 * 1/2002 Hsueh ..... E04F 13/0812 52/764
2004/0239214 A1 * 12/2004 Lines ..... A47F 10/06 312/236
2009/0096331 A1 * 4/2009 Park ..... D06F 39/12 312/107
2011/0101836 A1 * 5/2011 Gamble ..... A47B 95/002 312/293.3

(Continued)

FOREIGN PATENT DOCUMENTS

GB 2066064 B 8/1983
JP 3864531 B2 1/2007

*Primary Examiner* — Daniel J Rohrhoff
(74) *Attorney, Agent, or Firm* — Dority & Manning, P.A.

(57) ABSTRACT

A toe kick plate system includes a fixed plate configured to affix to an appliance, and the fixed plate includes a plurality of threaded inserts. A plurality of plate brackets are each threaded to a respective one of the plurality of threaded inserts of the fixed plate. The plurality of plate brackets are attached such that a gap formed between the fixed plate and the plurality of plate brackets are selectively adjustable by rotating the respective one of the plurality of plate brackets. A toe kick plate may be removably connected to the ends of the plurality of plate brackets.

16 Claims, 9 Drawing Sheets

(56) References Cited

U.S. PATENT DOCUMENTS

| | | | | |
|---|---|---|---|---|
| 2012/0280607 | A1* | 11/2012 | Doberstein | F25D 23/00 312/401 |
| 2013/0113353 | A1* | 5/2013 | Carr | A47L 15/4265 312/293.3 |
| 2018/0125329 | A1* | 5/2018 | Parmeggiani | A47L 15/488 |
| 2019/0170293 | A1* | 6/2019 | Davison | A47L 15/4251 |
| 2022/0090838 | A1* | 3/2022 | Pizzi | F25D 29/003 |
| 2023/0296261 | A1* | 9/2023 | Kahane | F24C 15/08 126/19 R |

* cited by examiner

SYSTEMS AND METHODS FOR THE ADJUSTMENT OF TOE KICK PLATES

FIELD OF THE INVENTION

The present subject matter relates generally to systems and methods for adjusting toe kick plates.

BACKGROUND OF THE INVENTION

An ergonomic choice for cabinetry manufacturers is to include a small recess at the base of cabinetry called a toe kick. The toe kick is set so that users may stand closer to the cabinetry when using a countertop or space above the cabinetry. When the user is closer to the countertop, the user may experience better balance and reduced fatigue when reaching across the countertop to work. In the absence of a toe kick, users may find themselves standing back from the countertop or cabinetry in order to avoid stubbing toes. Such a posture may lead to leaning over and putting considerable strain on the back, shoulders, and arms. However, despite widespread adoption of toe kicks, there is no set industry recess depth standard for toe kicks.

Appliance manufacturers have also adopted the idea of a toe kick. This has led to many appliances including a toe kick plate recessed and assembled on the appliance before the appliance is installed into the cabinetry. These toe kick plates may be built into the appliance at a fixed depth. When appliances are installed in a building, such as a household, the appliance may be installed straight into the cabinetry. Accounting for various toe kick depths can be difficult.

BRIEF DESCRIPTION OF THE INVENTION

Aspects and advantages of the invention will be set forth in part in the following description, or may be apparent from the description, or may be learned through practice of the invention.

In one example embodiment, a toe kick plate system includes a fixed plate configured to affix to an appliance. The fixed plate includes a plurality of threaded inserts. The toe kick plate system also includes a plurality of plate brackets, each threaded to a respective one of the plurality of threaded inserts of the fixed plate. The plurality of plate brackets are configured such that a gap between a distal end of a respective one of the plurality of plate brackets and the fixed plate is selectively adjustable by rotating the respective one of the plurality of plate brackets relative to the fixed plate. The toe kick plate system further includes a toe kick plate removably connected to the distal ends of the plurality of plate brackets.

In another example embodiment, a method for adjusting a toe kick plate that includes rotating each of a plurality of plate brackets, where each of the plurality of plate brackets are threaded to a respective one of a plurality of threaded inserts on a fixed plate. The plurality of plate brackets are configured such that a gap between a distal end of a respective one of the plurality of plate brackets and the fixed plate is selectively adjustable. The method also includes fastening a toe kick plate to the distal ends of the plurality of plate brackets.

In another example embodiment, an appliance includes a cabinet with a toe kick plate system positioned at a bottom portion of the cabinet. The toe kick plate system includes a plurality of threaded inserts installed on the cabinet of the appliance, as well as a plurality of plate brackets each threaded to a respective one of the plurality of threaded inserts of the cabinet. The plurality of plate brackets are configured such that a gap between a distal end of a respective one of the plurality of plate brackets and the cabinet is selectively adjustable by rotating each of the plurality of plate brackets relative to the cabinet. Additionally, the toe kick plate system includes a toe kick plate removably connected to the distal ends of the plurality of plate brackets.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
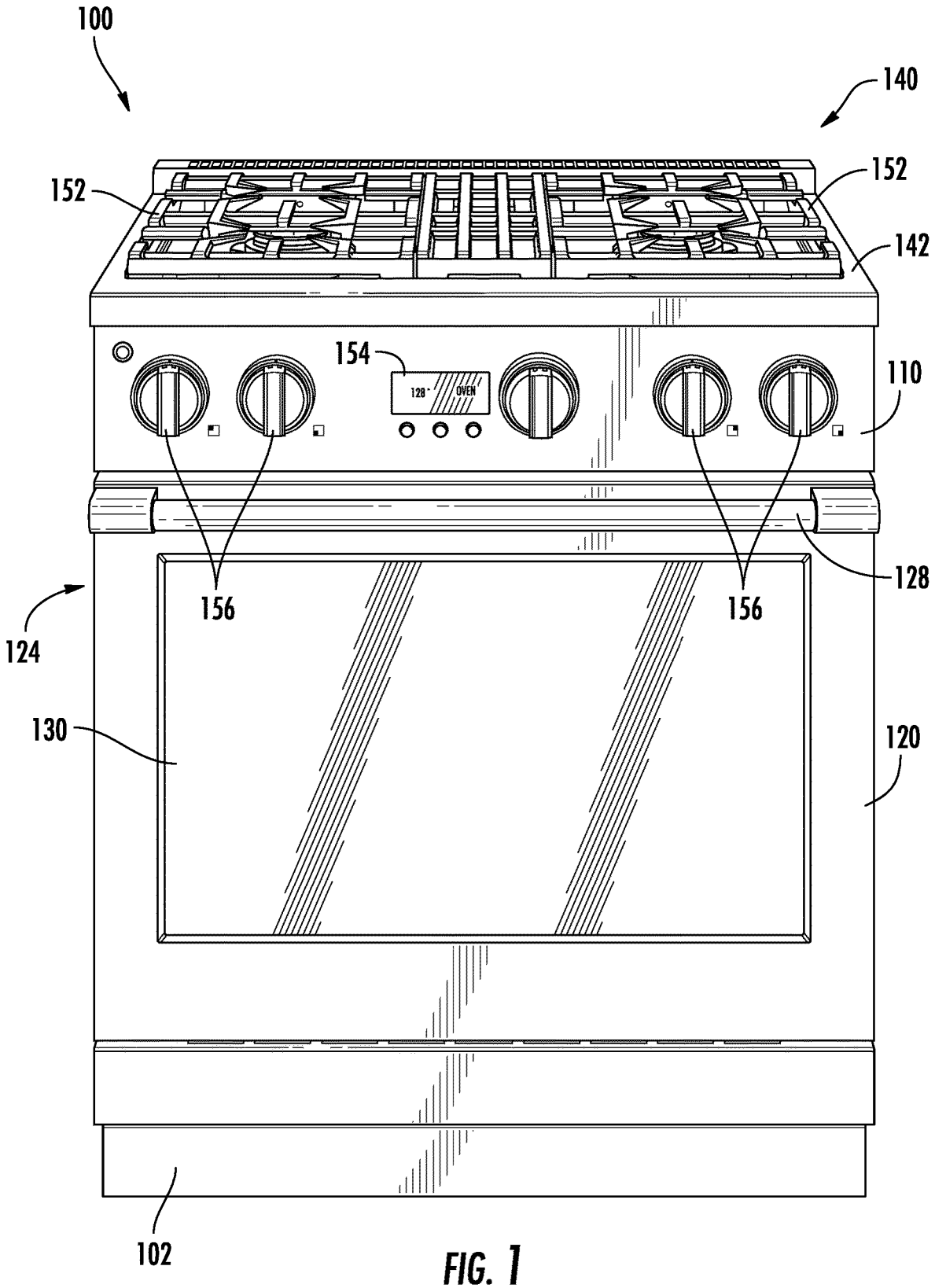
FIG. 1 is a front, perspective view of a range appliance according to an example embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The terms "includes" and "including" are intended to be inclusive in a manner similar to the term "comprising." Similarly, the term "or" is generally intended to be inclusive (i.e., "A or B" is intended to mean "A or B or both").

Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a ten percent (10%) margin.

Figure 2:
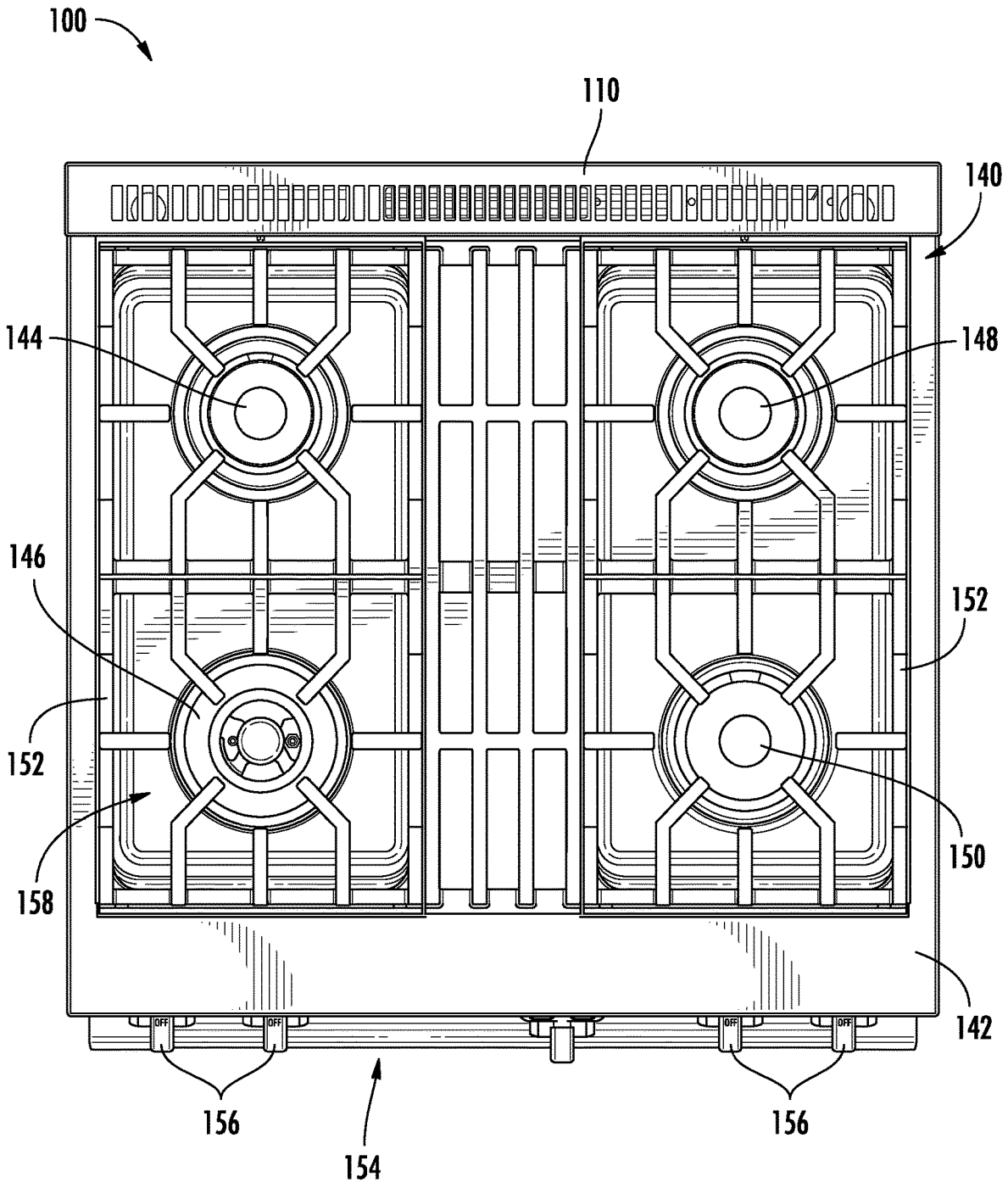
FIG. 2 is a top, plan view of the example range appliance of FIG. 1.

Referring now to the figures, an example range appliance 100 with an example toe kick plate system 102 will be described in accordance with example aspects of the present subject matter. FIG. 1 provides a front, perspective view of a range appliance 100 with toe kick plate system 102 as may be employed with the present subject matter. FIG. 2 provides a top, plan view of range appliance 100. Range appliance 100 includes an insulated cabinet 110. Cabinet 110 defines a cooking chamber 120. Thus, range appliance 100 is generally referred to as an oven range appliance. As will be understood by those skilled in the art, range appliance 100 is provided by way of example only, and the present subject matter may be used in any suitable appliance, e.g., a double oven range appliance, a standalone cooktop appliance, a dishwasher appliance, a refrigerator appliance, a freezer appliance, a wine cooler appliance, a trash compactor, a stand-alone icemaker appliance, etc. Thus, the exemplary embodiment shown in FIG. 1 is not intended to limit the present subject matter to any particular cooking chamber configuration, arrangement, or cooking appliance.

Cooking chamber 120 may be configured for the receipt of one or more food items to be cooked. Range appliance 100 includes a door 124 rotatably attached to cabinet 110 in order to permit access to cooking chamber 120. Handle 128 may mount to door 124 to assist a user with opening and closing door 124 in order to access cooking chamber 120. As an example, a user can pull on handle 128 mounted to door 124 to open or close door 124 and access cooking chamber 120. Glass windowpane 130 may provide for viewing the contents of cooking chamber 120 when door 124 is closed, and also may assist with insulating cooking chamber 120. Heating elements (not shown), such as electric resistance heating elements, gas burners, microwave heating elements, halogen heating elements, or suitable combinations thereof, are positioned within cooking chamber 120 for heating cooking chamber 120.

Range appliance 100 also includes a cooktop 140. Cooktop 140 is positioned at or adjacent a top portion of cabinet 110. Thus, cooktop 140 is positioned above cooking chamber 120. Cooktop 140 includes a top panel 142. By way of example, top panel 142 may be constructed of glass, ceramics, enameled steel, and combinations thereof.

For range appliance 100, a utensil holding food and/or cooking liquids (e.g., oil, water, etc.) may be placed onto grates 152 at a location of any of burner assemblies 144, 146, 148, 150. Burner assemblies 144, 146, 148, 150 provide thermal energy to cooking utensils on grates 152. As shown in FIG. 1, burners assemblies 144, 146, 148, 150 can be configured in various sizes so as to provide e.g., for the receipt of cooking utensils (i.e., pots, pans, etc.) of various sizes and configurations and to provide different heat inputs for such cooking utensils. Grates 152 are supported on a top surface 158 of top panel 142.

A user interface panel 154 is located within convenient reach of a user of the range appliance 100. For this exemplary embodiment, user interface panel 154 includes knobs 156 that are each associated with one of burner assemblies 144, 146, 148, and 150. Knobs 156 allow the user to activate each burner assembly and determine the amount of heat input provided by each burner assembly 144, 146, 148, and 150 to a cooking utensil located thereon. User interface panel 154 may also be provided with one or more graphical display devices that deliver certain information to the user such as e.g., whether a particular burner assembly is activated and/or the rate at which the burner assembly is set.

Although shown with knobs 156, it should be understood that knobs 156 and the configuration of range appliance 100 shown in FIGS. 1 and 2 are provided by way of example only. More specifically, user interface panel 154 may include various input components, such as one or more of a variety of touch-type controls, electrical, mechanical or electromechanical input devices including rotary dials, push buttons, and touch pads. The user interface panel 154 may include other display components, such as a digital or analog display device designed to provide operational feedback to a user.

Figure 3:
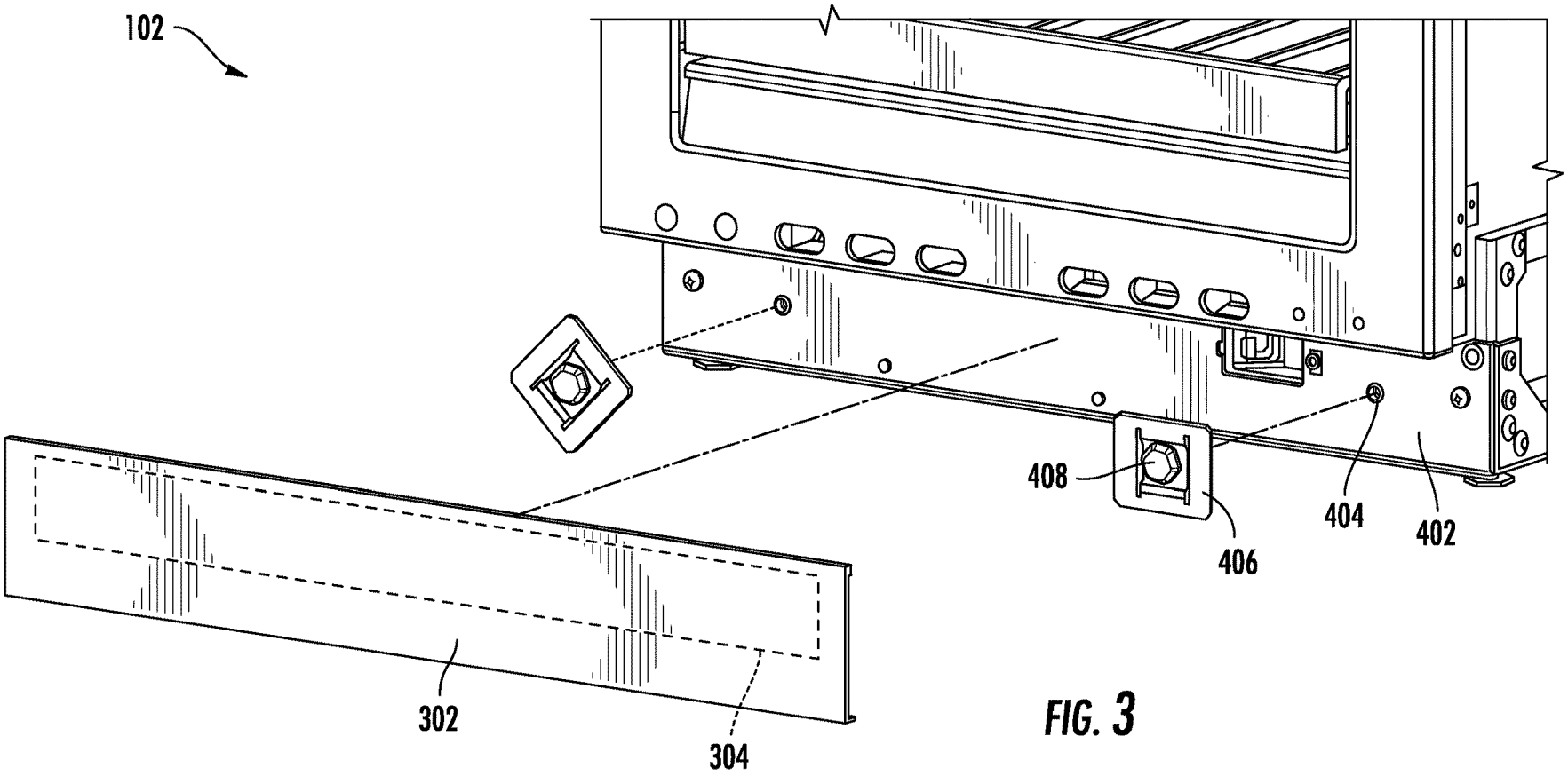
FIG. 3 is an exploded perspective view of a toe kick plate system of the example range appliance of FIG. 1.

FIG. 3 provides an exploded view of a toe kick plate system 102 according to an example embodiment of the present disclosure, specifically with a toe kick plate 302 and a fastener 304 detached from other components of toe kick plate system 102. Toe kick plate system 102 may assist a consumer with adjusting the depth of toe kick plate system 102 to match, be greater than, or be less than the depth of a toe kick of adjoining cabinetry. Toe kick plate 302 may be a decorative piece or panel made of a suitable material, such as stainless steel, wood, plastic, or other such materials, and may be selected by a consumer to match the appliance 100 or cabinetry proximate the toe kick plate 302. Fastener 304 may be chosen from various fastening systems, such as magnets, adhesive tapes, or a hook-and-loop systems, as fasteners for toe kick plate 302. For example, a consumer may choose to have a decorative stainless steel toe kick plate 302, with magnets as fastener 304, as a part of toe kick plate system 102.

Figure 4:
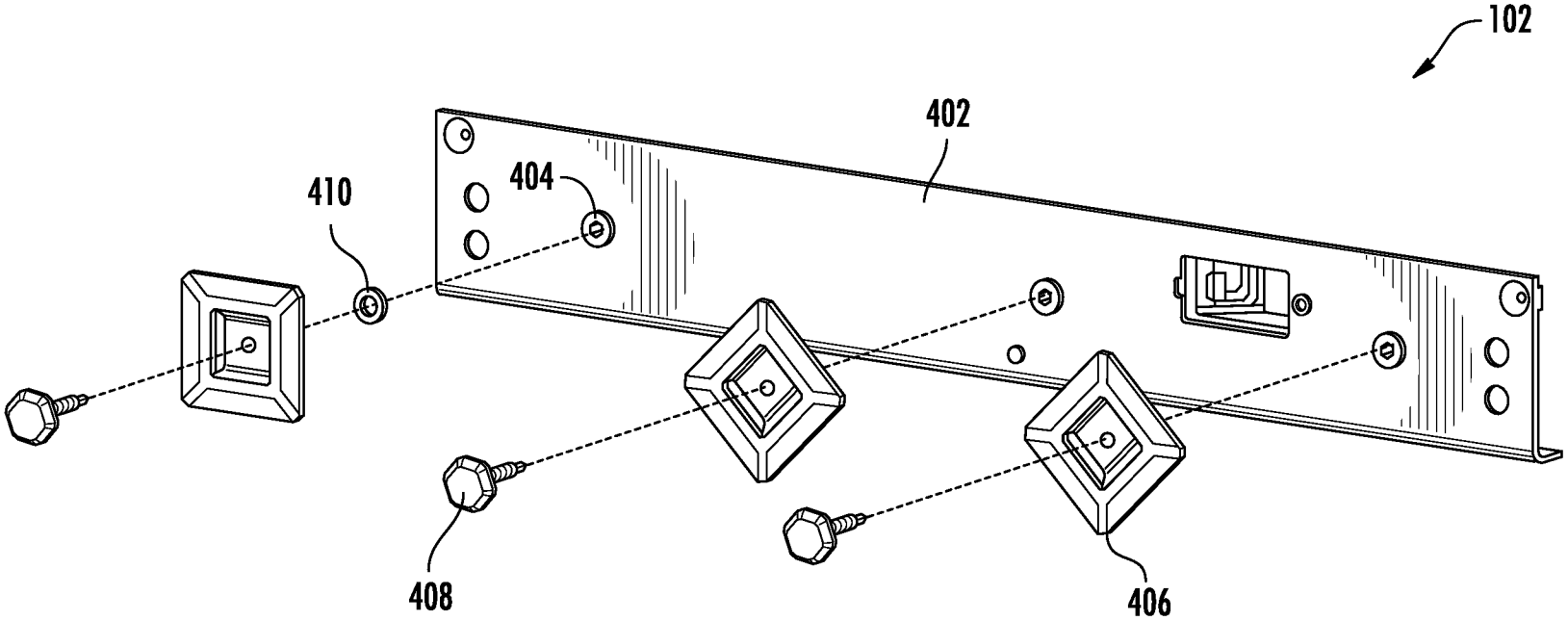
FIG. 4 is a perspective view of the toe kick plate system of FIG. 3.
Figure 7:
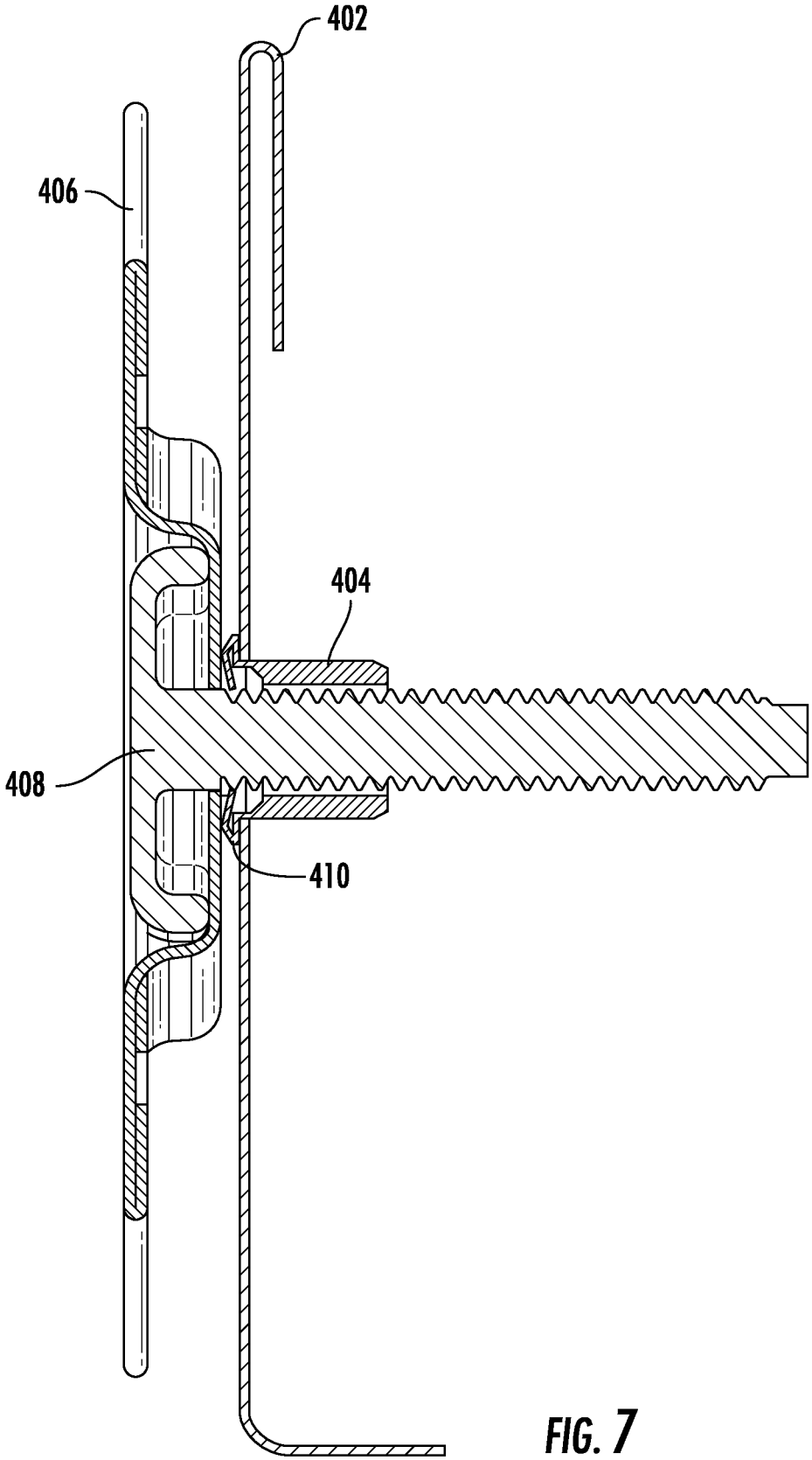
FIG. 7 is a cross-section view of a plate bracket assembly of the example toe kick plate system of FIG. 3.
Figure 8:
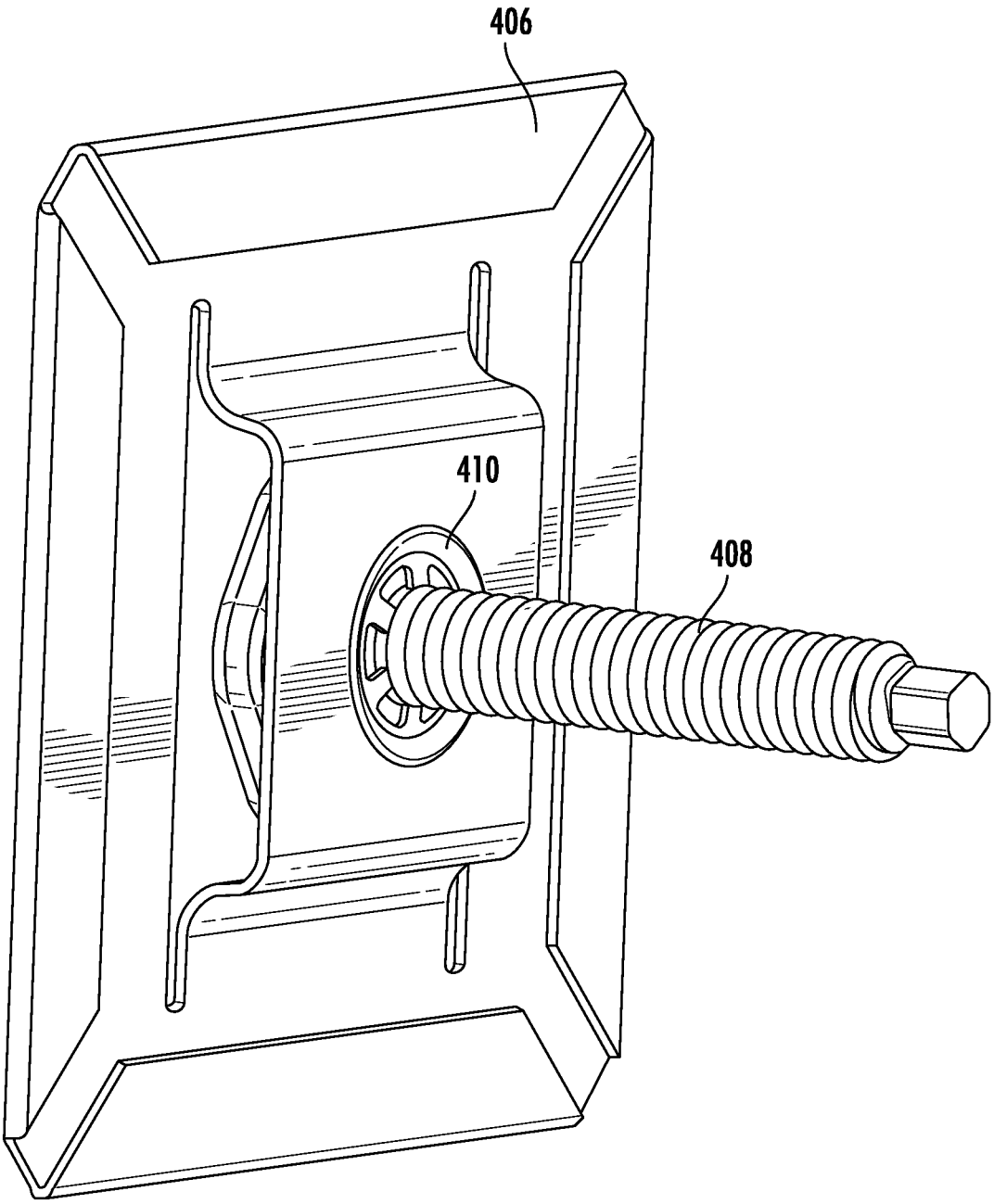
FIG. 8 is a rear perspective view of some of certain components of a plate bracket assembly of the example toe kick plate system of FIG. 3.

FIG. 4 provides a detailed view of the adjustable portion of the toe kick plate system 102. Fixed plate 402 may be a plate that is fixedly mounted to the appliance, or may alternatively be part of the cabinetry frame of an associated appliance. Fixed plate 402 may contain two or more (e.g., three) threaded inserts 404, which are used to connect the plate brackets 406 to the fixed plate 402. Threaded inserts 404 may be rivet nuts or welded nuts in or on fixed plate 402. Threaded inserts 404 may alternatively be punched with a thread form tool or with an extruded hole punch on fixed plate 402. Threaded posts 408, in conjunction with retaining rings 410, may be used to secure plate brackets 406 to the fixed plate 402, and allow the rotation of the plate brackets 406 to adjust the recess depth of the toe kick plate 302, best shown in FIGS. 7 and 8. FIG. 7 provides a cross-sectional view of the plate brackets 406 assembly, and FIG. 8 provides a rear perspective view of certain components of the plate brackets 406 assembly. If threaded posts 408 have a retaining form formed into the post during fabrication, then retaining rings 410 may not be necessary. Threaded posts 408 may be a bolt or screw with a head on at least one end. Plate brackets 406 may have an inset portion for the head of the threaded posts 408 to sit so that the head of the threaded posts 408 are flush with the outer surface of the plate brackets 406, e.g., that faces toe kick plate 302. The inset in plate brackets 406 may also be shaped to keep threaded post 408 from rotating, with respect to plate bracket 406, when a user adjusts plate bracket 406. With a flat mounting surface, toe kick plate 302 may effectively mount to plate brackets 406. Having a head on at least one end of the threaded posts 408 may assist with securing plate brackets 406 to threaded posts 408. Retaining rings 410 are pushed on and force fit to the threaded posts 408 on the opposite side of plate brackets 406 with respect to the head of threaded posts 408. In an alternative example embodiment, if threaded posts 408 have an increased head size as well as a retaining form formed into the post during fabrication, then plate brackets 406 and/or retaining rings 410 may not be necessary.

Figure 5:
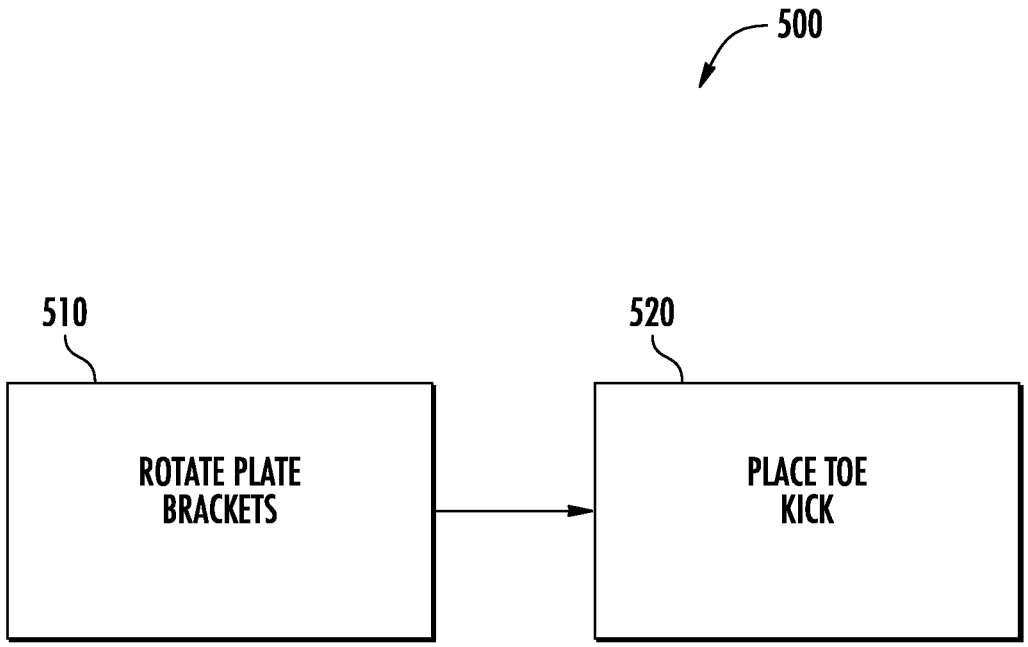
FIG. 5 is a flowchart of a method of adjusting a toe kick plate system according to an example embodiment of the present disclosure.

FIG. 5 demonstrates a method 500 for adjusting toe kick plate system 102. Method 500 begins at 510 which includes rotating each of plate bracket 406 to the desired recess depth. As may be seen from the above, the retaining ring 410 secures the plate bracket 406 to threaded post 408, enabling the rotation of plate bracket 406 to rotate threaded post 408, which threadedly engages the fixed plate 402. Rotating plate bracket 406 then rotates the threads of threaded post 408 further in or out of the fixed plate 402, adjusting the recess depth. Moreover, by rotating threaded post 408 relative to fixed plate 402, a gap or distance between plate bracket 406 and fixed plate 402 may be adjusted at 510. Advantageously, in certain example embodiments, the respective distance between plate brackets 406 and fixed plate 402 may be independently adjustable, e.g., to the same or different distances, to account for a variety of adjacent toe kick depths. At 520, the consumer can place, or fasten, the decorative toe kick plate 302 onto the adjusted plate bracket 406. The depth of decorative toe kick plate 302 may advantageously match or complement the depth of adjacent cabinetry toe kicks due to the adjustment of plate brackets 406 at 510. As may be seen above, the toe kick plate 302 may be constructed from a variety of different materials. Fastener 304 may include magnets, adhesives, or hook and loop fastening styles.

Figure 6:
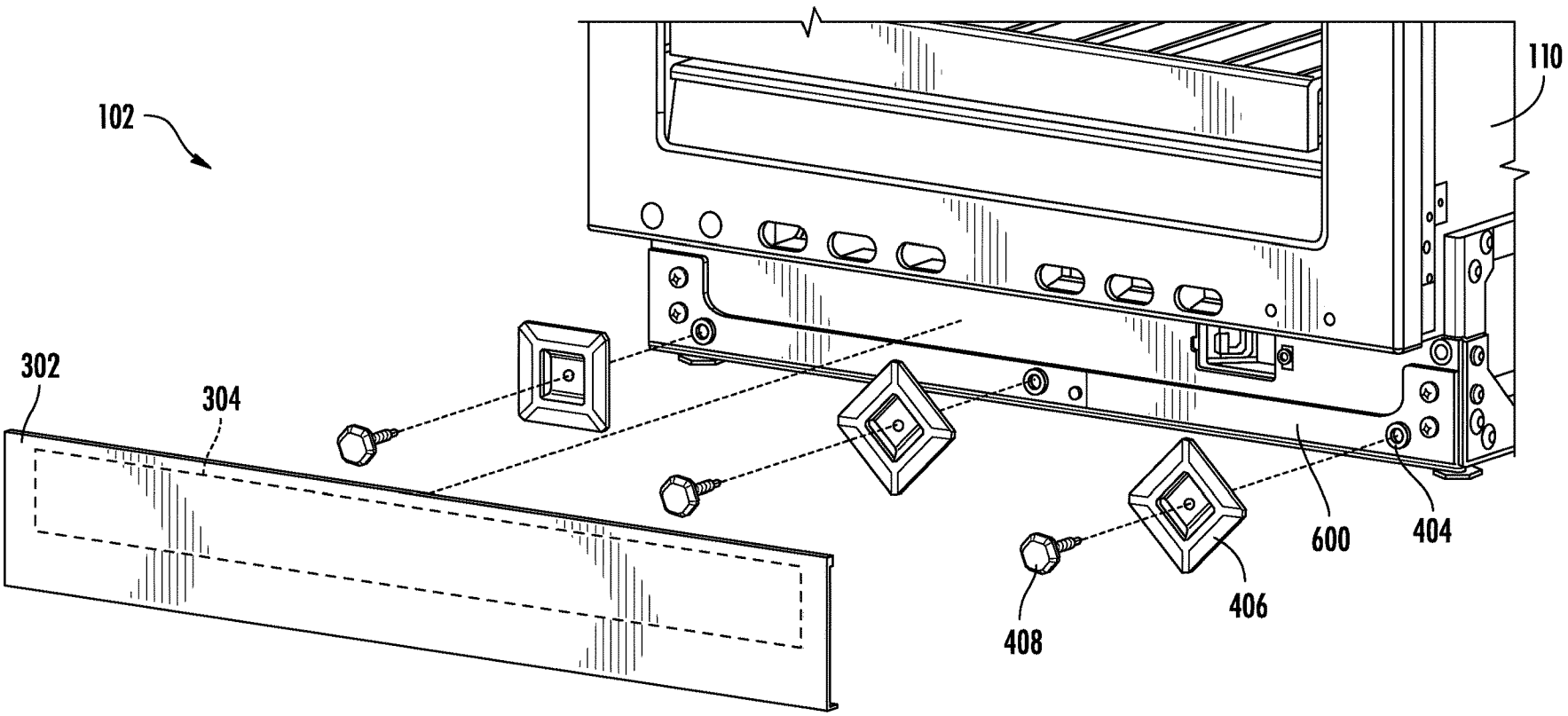
FIG. 6 is an exploded perspective view of a toe kick plate system mounted to the cabinet according to another example embodiment of the present disclosure.

FIG. 6 illustrates a view at another example embodiment, where the toe kick plate system 102 connects directly to baseplate 600 of appliance 100. In another example embodiment, baseplate 600 of appliance 100 may be a part of cabinet 110. Whether connecting toe kick plate system 102 to cabinet 110, fixed plate 402, or baseplate 600, toe kick plate system 102 may operate in the same manner described above.

FIGS. 7 and 8 provide alternative views of the plate bracket assembly. FIG. 7 illustrates a side section view of the plate bracket assembly mounted to fixed plate 402. As shown in FIG. 8, retaining ring 410 secures the plate bracket 406 to threaded post 408 from the opposing side of the inset of plate bracket 406. In an alternative embodiment, retaining ring 410, plate bracket 406, and threaded post 408 may be manufactured as a singular part.

Figure 9:
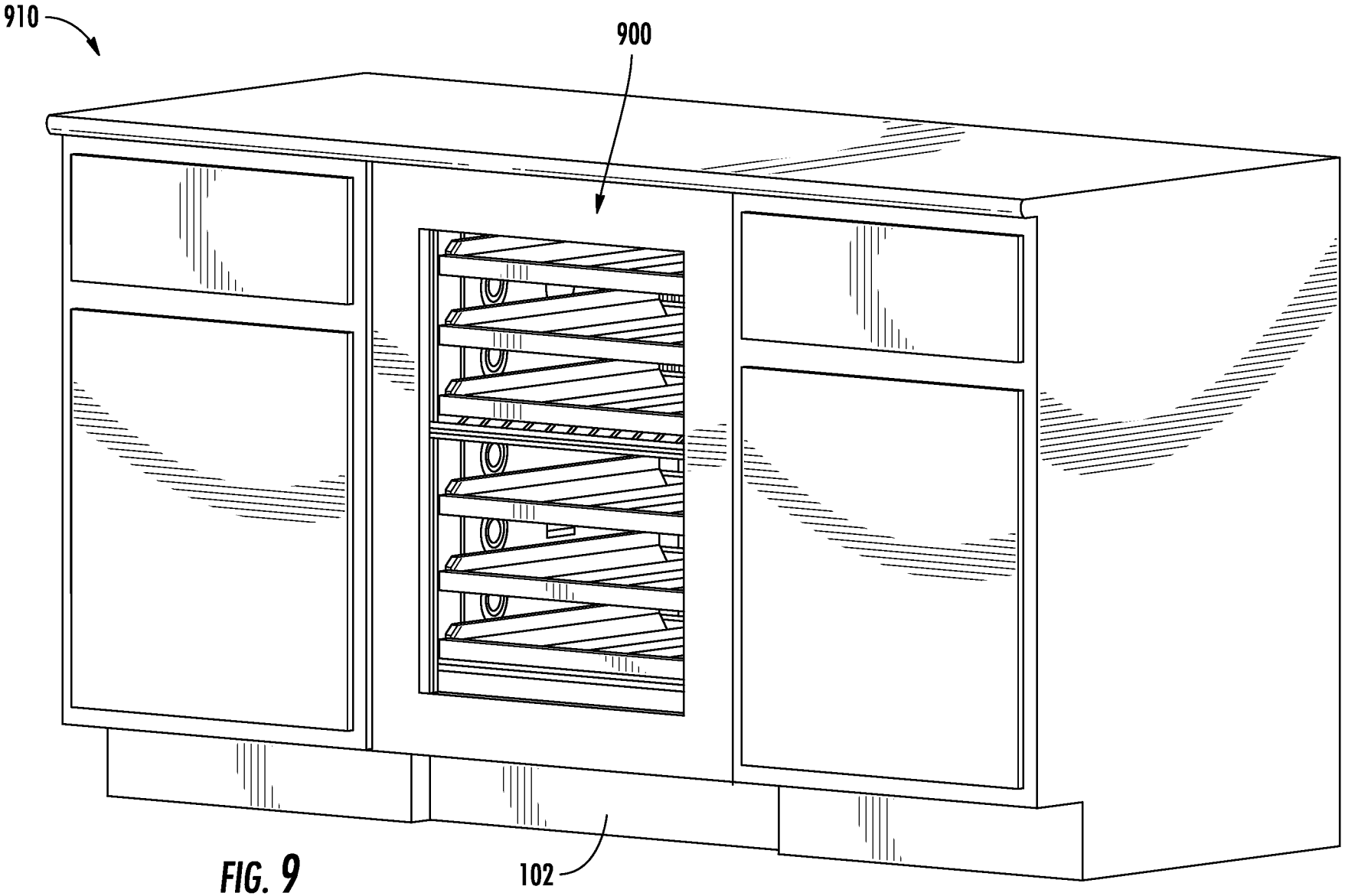
FIG. 9 is a perspective view of the toe kick plate system installed on an appliance according to another example embodiment positioned within cabinetry.

FIG. 9 is another example embodiment of toe kick plate system 102. In this example embodiment, appliance 900, a wine cooler appliance, is set within cabinetry 910. The application of toe kick plate system 102 may be seen in FIG. 9, as toe kick plate system 102 has been set to match the depth of cabinetry 910. As stated above, toe kick plate system 102 may be used in any suitable appliance, e.g., a double oven range appliance, a standalone cooktop appliance, a dishwasher appliance, a refrigerator appliance, a freezer appliance, a wine cooler appliance, a trash compactor, a stand-alone icemaker appliance, etc. The provided example embodiments are provided by way of example only and are not intended to limit the present subject matter.

FIG. 5 depicts steps performed in a particular order for purposes of illustration and discussion. Those of ordinary skill in the art, using the disclosures provided herein, will understand that the steps of any of the methods discussed herein may be adapted, rearranged, expanded, omitted, or modified in various ways without deviating from the scope of the present disclosure. Moreover, although aspects of method 500 are explained using toe kick plate system 102 as an example, it should be appreciated that these methods may be applied to the operation of any suitable toe kick plate system.

As may be seen in FIG. 5, method 500 includes two steps. First, at 510, the user rotates each of plate bracket 406 to a desired depth. As stated above, since plate bracket 406 is threadedly engaged to fixed plate 402, when the user rotates plate bracket 406, plate bracket 406 will move axially in or out, adjusting the recess depth. At 520, the user may place toe kick plate 302 onto the plate bracket 406, via fastener 304. As stated above, fastener 304 may include magnets, adhesives, or hook and loop fastening styles.

As may be seen from the above, the adjustable toe kick plate system 102 allows the consumer to adjust a depth of toe kick plate 302 in and out by turning plate bracket 406. such adjustment allows for the moving toe kick plate 302 to various depths to account for the various depths of cabinetry toe kicks. Once the adjustment is made, the decorative toe kick plate 302 may be fastened to plate bracket 406 to complete toe kick plate system 102.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A toe kick plate system, comprising:

a fixed plate configured to affix to an appliance, the fixed plate comprises a plurality of threaded inserts;

a plurality of plate brackets each threaded to a respective one of the plurality of threaded inserts of the fixed plate, the plurality of plate brackets configured such that a gap between a distal end of a respective one of the plurality of plate brackets and the fixed plate is selectively adjustable by rotating each of the plurality of plate brackets relative to the fixed plate; and a toe kick plate removably connected to the distal ends of the plurality of plate brackets, wherein the plate brackets comprise an inset portion for a head of a threaded post to sit either below or flush with a surface on a first side of the plate brackets, and wherein the threaded post comprises a retaining ring force fit to the threaded post on a second side of the plate brackets opposite the first side of the plate brackets.

2. The toe kick plate system of claim 1, wherein the threaded inserts comprise one or more of a rivet nut and a welded nut.

3. The toe kick plate system of claim 1, wherein the threaded inserts are punched by one of a thread form tool and an extruded hole punch.

4. The toe kick plate system of claim 1, wherein the threaded post comprises one or more of a bolt, and a screw.

5. The toe kick plate system of claim 1, further comprising a fastening system for removably connecting the toe kick plate to the plate brackets, the fastening system comprising one of magnets, hook and loop fasteners, and adhesive.

6. A method for adjusting a toe kick plate, the toe kick plate comprising a plurality of plate brackets, the plate brackets comprising an inset portion for a head of a threaded post to sit either below or flush with a surface on a first side of the plate brackets, and wherein the threaded post comprises a retaining ring force fit to the threaded post on a second side of the plate brackets opposite the first side of the plate brackets, the method comprising:

rotating each of a plurality of plate brackets, each threaded to a respective one of a plurality of threaded inserts on a fixed plate, the plurality of plate brackets configured such that a gap between a distal end of a respective one of the plurality of plate brackets and the fixed plate is selectively adjustable; and fastening a toe kick plate to the distal ends of the plurality of plate brackets.

7. The method of claim 6, wherein the threaded inserts comprise one or more of a rivet nut and a welded nut.

8. The method of claim 6, wherein the threaded inserts are punched by one of a thread form tool and an extruded hole punch.

9. The method of claim 6, wherein the threaded post comprises one or more of a bolt, and a screw.

10. The method of claim 6, further comprising a fastening system for removably connecting the toe kick plate to the plate brackets, the fastening system comprising one of magnets, hook and loop fasteners, and adhesive.

11. An appliance, comprising:

a cabinet; and a toe kick plate system positioned at a bottom portion of the cabinet, the toe kick plate system comprising, a fixed plate affixed to the cabinet appliance, the fixed plate comprising a plurality of threaded inserts, a plurality of plate brackets each threaded to a respective one of the plurality of threaded inserts of the fixed plate, the plurality of plate brackets configured such that a gap between a distal end of a respective one of the plurality of plate brackets and the fixed plate is selectively adjustable by rotating each of the plurality of plate brackets relative to the fixed plate, and a toe kick plate removably connected to the distal ends of the plurality of plate brackets, wherein the plate brackets comprise an inset portion for a head of a threaded post to sit either below or flush with a surface on a first side of the plate brackets, and wherein the threaded post comprises a retaining ring force fit to the threaded post on a second side of the plate brackets opposite the first side of the plate brackets.

12. The appliance of claim 11, wherein the threaded inserts comprise one or more of a rivet nut and a welded nut.

13. The appliance of claim 11, wherein the plate brackets comprise an inset portion for a head of a threaded post to sit either below or flush with a surface of the plate brackets and prevent rotation of the threaded post while adjusting the plate brackets.

14. The appliance of claim 13, wherein the threaded post comprises one or more of a bolt, and a screw.

15. The appliance of claim 11, wherein the threaded inserts are punched by one of a thread form tool and an extruded hole punch.

16. The appliance of claim 11, further comprising a fastening system for removably connecting the toe kick plate to the plate brackets, the fastening system comprising one of magnets, hook and loop fasteners, and adhesive.

* * * * *